US005174558A

United States Patent [19]

Sanborn, III

[11] Patent Number: 5,174,558

[45] Date of Patent: Dec. 29, 1992

[54] AUTOMATIC FEEDER FOR WORKPIECES OF LIMP MATERIAL

[75] Inventor: Charles H. Sanborn, III, Shelbyville, Tenn.

[73] Assignee: Ark, Inc., Shelbyville, Tenn.

[21] Appl. No.: 733,291

[22] Filed: Jul. 22, 1991

Related U.S. Application Data

[63] Continuation-in-part of Ser. No. 445,539, Dec. 4, 1989, Pat. No. 5,082,267.

[51] Int. Cl.[5] ..... B65H 3/00

[52] U.S. Cl. ..... 271/10; 271/275; 271/147; 271/265

[58] Field of Search ..... 271/6, 10, 11, 12, 34, 271/147, 157, 162, 167, 198, 275, 277, 265

[56] References Cited

U.S. PATENT DOCUMENTS

| | | | |
|---|---|---|---|
| 3,670,674 | 6/1972 | Conner, Jr. | 112/121.29 |
| 3,768,807 | 10/1973 | Spengler | 271/5 |
| 4,157,823 | 6/1979 | Morton | 271/10 |
| 4,202,441 | 5/1980 | Bourgeois | 198/779 |
| 4,579,329 | 4/1986 | Frost et al. | 271/10 |
| 4,645,193 | 2/1987 | Walton et al. | 271/18.3 |
| 4,881,479 | 11/1989 | Freermann | 112/262.3 |
| 5,082,267 | 1/1992 | Sanborn, III | 271/10 |

FOREIGN PATENT DOCUMENTS

| | | | |
|---|---|---|---|
| 203802 | 3/1986 | European Pat. Off. | 271/10 |
| 1948246 | 9/1969 | Fed. Rep. of Germany | 198/779 |
| 2538240 | 3/1977 | Fed. Rep. of Germany | 271/10 |
| 706552 | 3/1931 | France | 271/12 |
| 36247 | 2/1985 | Japan | 271/10 |

*Primary Examiner*—Robert P. Olszewski
*Assistant Examiner*—Steven M. Reiss
*Attorney, Agent, or Firm*—Senniger, Powers, Leavitt & Roedel

[57] ABSTRACT

Apparatus for automatically feeding workpieces of limp material one at a time and one after another from a stack thereof to a device for operating thereon, e.g. for feeding plies of fabric from a stack of plies to sewing apparatus, comprising an endless conveyor having spaced flights and gaps. The stack is held under an upper reach of the conveyor on a table. The space between the gaps is substantially less than the dimension of the table in the direction of travel of the upper reach of the conveyor. A pick-up is operable through the gaps to grasp the top workpiece of the stack and pick it up with the workpiece extending down in a gap. The bottom surface of the workpiece is engaged by the oncoming flight of the conveyor to complete the separation of the workpiece from the stack and to bring it to lie generally flat on the oncoming flight.

6 Claims, 7 Drawing Sheets

AUTOMATIC FEEDER FOR WORKPIECES OF LIMP MATERIAL

The U.S. Government has a paid-up license in this invention and the right in limited circumstances to require the patent owner to license others on reasonable terms as provided for by the terms of contract No. DLA 900-87-C-0509 awarded by the Department of Defense.

This application is a continuation in part of U.S. application Ser. No. 445,539, filed Dec. 4, 1989, now U.S. pat. No. 5,082,267 of Jan. 21, 1992.

BRIEF SUMMARY OF THE INVENTION

This invention relates to automatic feeders for workpieces of limp material, and more particularly to apparatus for automatically feeding workpieces of fabric or the like one at a time and one after another from a stack thereof to means such as a sewing machine for operation thereon.

The invention is in the same general category as the apparatus shown, for example, in U.S. Pat. Nos. 3,670,674 and 4,157,823, being directed toward automating the sewing of workpieces of fabric or the like, and more particularly directed toward the separation and pick-up of a single fabric workpiece, referred to as a ply, from a stack of plies of fabric, and delivering the ply, lying flat, to sewing apparatus.

Among the several objects of the invention may be noted the provision of an improved automatic feeder for workpieces of limp material, and particularly for automatically and efficiently feeding plies of fabric or the like, from a stack of plies, to apparatus such as a sewing machine for operating on the plies; the provision of such apparatus for automatically feeding the plies from the stack at relatively high speeds without shifting of the plies as they are fed forward; and the provision of such apparatus capable of handling a broad range of sizes of plies.

In general, apparatus of this invention for automatically feeding workpieces of limp material one at a time and one after another from a stack thereof to means for operating thereon comprises an endless conveyor having a forward traveling upper reach for conveying the workpieces to the operating means and a lower return reach. The conveyor has a series of flights spaced at intervals therealong with openings between the flights, each flight being constructed for carrying a workpiece thereon with the workpiece lying on the flight and having a leading edge at that opening which leads the flight, means being provided for driving the conveyor for forward travel of its upper reach. The apparatus further comprises means positioned under the upper reach of the conveyor and between the upper and lower reaches of the conveyor for holding a stack of the workpieces. The means for holding a stack has a dimension parallel to the direction of travel of the upper reach of the conveyor which is at least as long as that of the longest workpiece to be handled by the apparatus. The space between adjacent flights of the conveyor is less than 50% of the dimension of the means for holding a stack. Transfer means for picking up the top workpiece of the stack, separating it from the stack, and bringing it to lie on a flight, comprises pick-up means movable from a retracted position above the upper reach of the conveyor down through an opening in the conveyor into engagement with the top workpiece of the stack.

The pick-up means is operable to qrasp the top workpiece and then move back upwardly through the opening to affect separation of the workpiece from the stack and lift the workpiece to a position wherein it extends down in the opening from the pick-up means for engagement of its bottom surface by the leading edge of the oncoming flight to complete the separation of the workpiece from the stack and to bring it to lie generally flat on said oncoming flight, the pick-up means then releasing the workpiece to complete the laying thereof on the oncoming flight.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
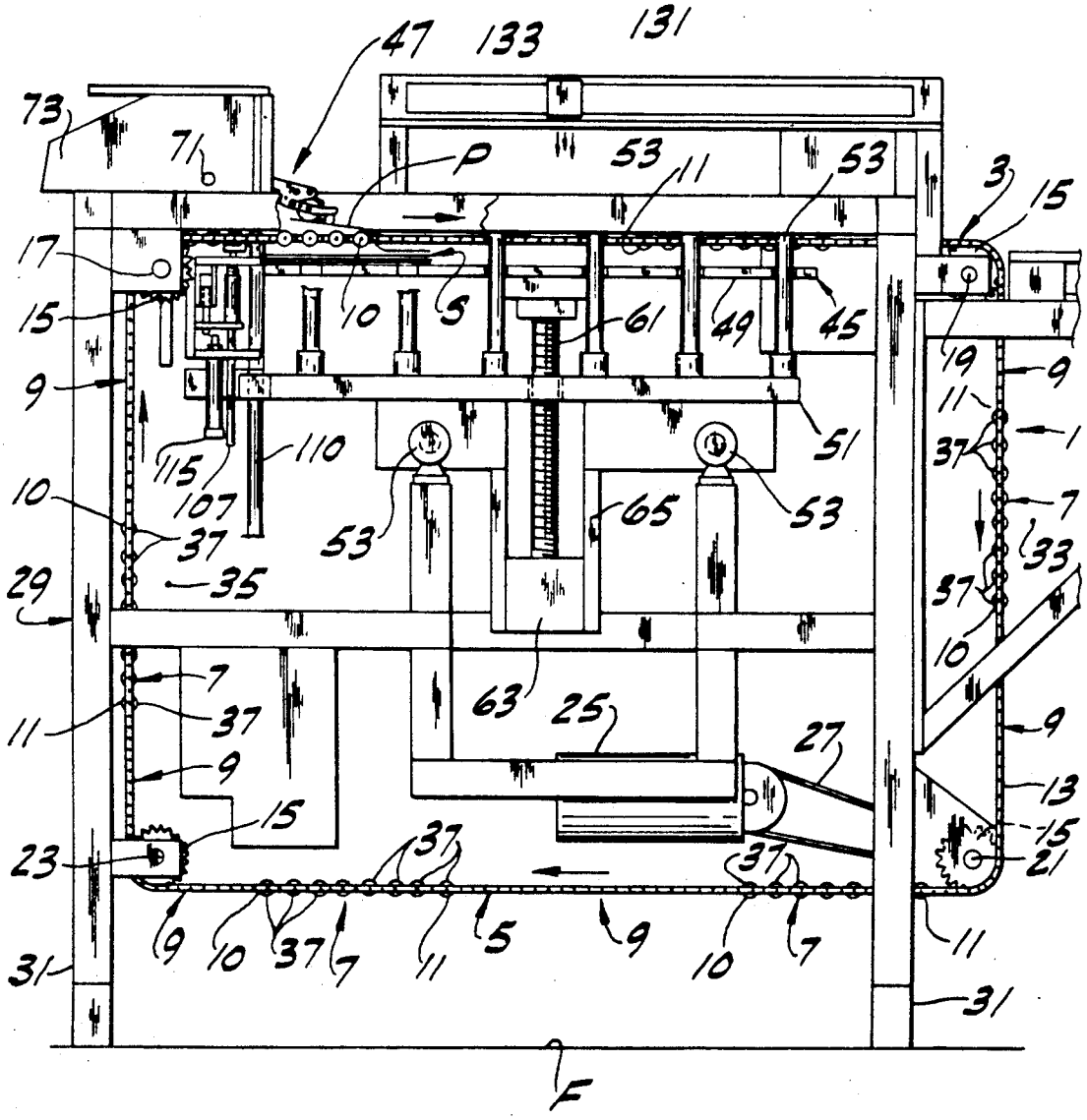
FIG. 1 is a view in side elevation of apparatus of this invention for automatically feeding workpieces such as "plies" of fabric one at a time and one after another from a stack thereof to means for operating thereon, parts being broken away.

Referring to the drawings, apparatus of this invention for automatically feeding workpieces of limp material, and particularly plies of fabric, one at a time and one after another from a stack thereof to means for operating on the workpieces is shown to comprise an endless conveyor generally designated 1 having a forward-traveling upper reach 3 for conveying the workpieces to the operating means (which is not shown herein, not being a part of this invention), and a lower return reach 5 below the upper reach. While the apparatus is adapted particularly for feeding plies of fabric, it is contemplated that its principles are adapted to apparatus for feeding other workpieces of limp material, e.g. sheets of tissue paper, bags, etc. The conveyor 1 is constructed to have a series of flights each designated 7 spaced at intervals therealong with openings or gaps each designated 9 between the flights. As herein illustrated, the conveyor has six flights and thus six openings or gaps between flights. Each flight is constructed for carrying a workpiece thereon with the workpiece lying on the flight, each flight having a leading edge 10 at that opening 9 which leads the flight (in relation to the direction of travel of the conveyor, which is clockwise as viewed in FIG. 1), and a trailing edge 11 which trails the flight. It will be understood that edge 10 is the trailing edge of a gap 9 and the edge 11 is the leading edge of the gap. More particularly, the conveyor 1 comprises a pair of endless chains, each designated 13, one being the left hand chain of the conveyor and the other the right hand chain of the conveyor, trained around sprockets such as indicated at 15 on a shaft 17 at the trailing end of the upper reach 3, a shaft 19 at the leading end of the upper reach, a shaft 21 below shaft 19 at the leading end of the lower reach 5, and a shaft 23 below shaft 17 at the leading end of the lower reach. Shaft 21 constitutes a drive shaft for the endless conveyor, being driven by suitable means such as the electric motor-speed reducer unit indicated at 25 and the chain and sprocket drive indicated at 27 in FIG. 1. The four shafts 17, 19, 21 and 23 are journalled in suitable bearings carried by a support or frame generally designated 29 having legs 31 standing on the floor F. With the arrangement shown, the conveyor has a downwardly traveling forward reach and an upwardly traveling rearward reach 35 indicated at 33 extending down from the leading end of its upper reach to the trailing end of its lower reach extending up from the leading end of its lower reach to the trailing end of its upper reach 3.

Figure 4:
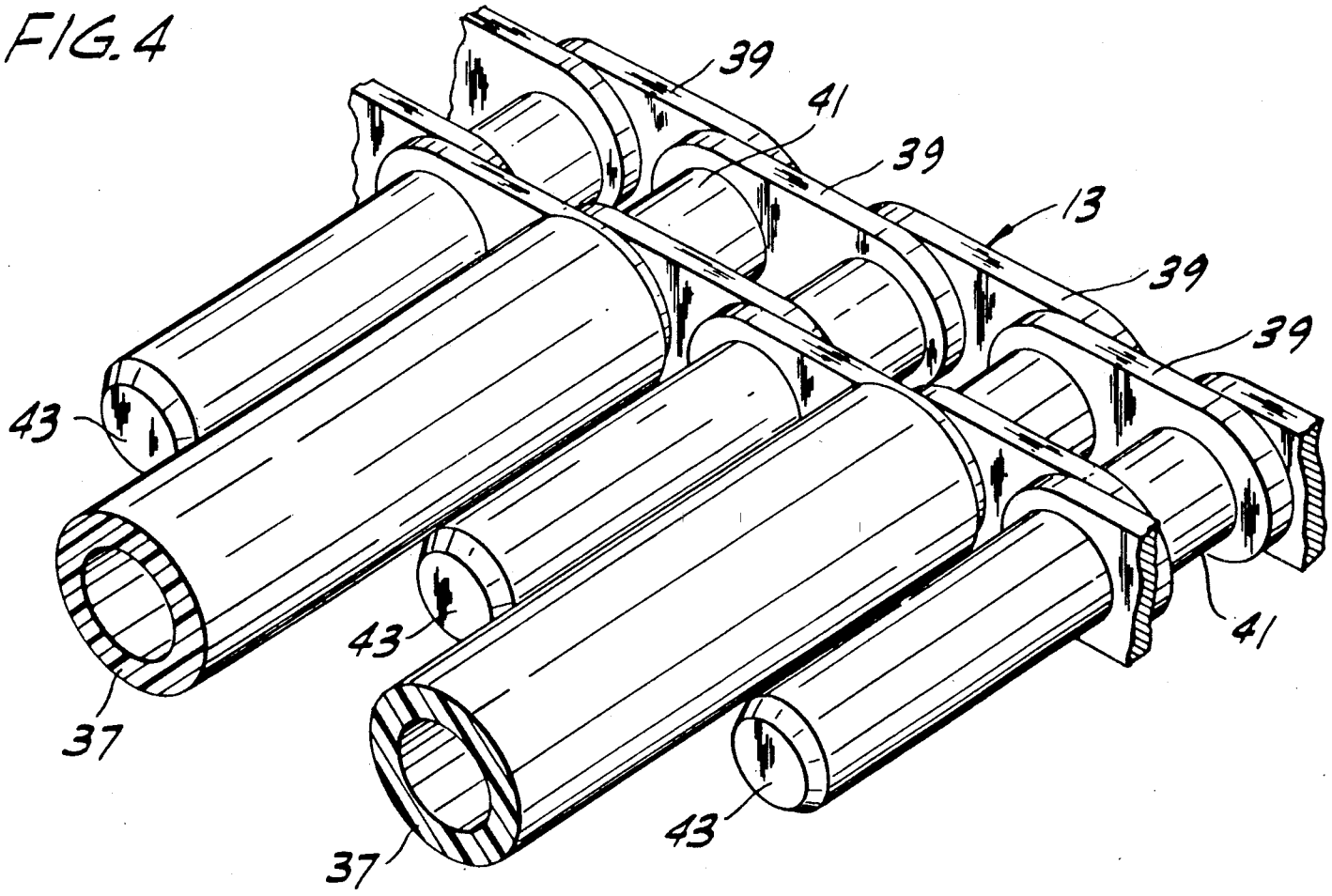
FIG. 4 is a perspective illustrating detail of the endless conveyor of the apparatus.
Figure 5:
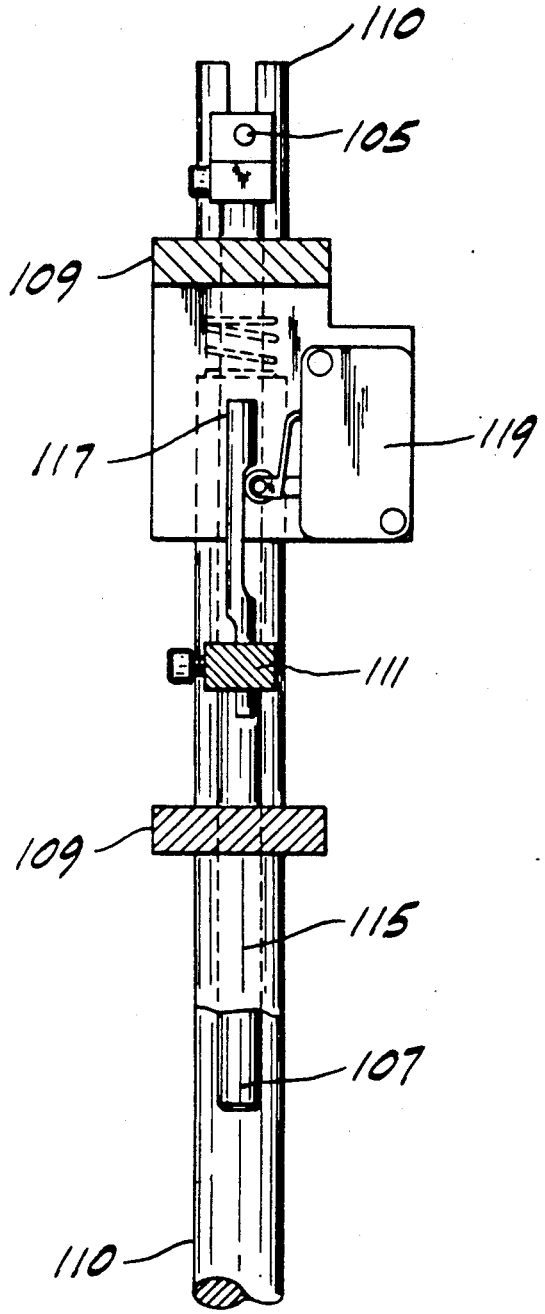
FIG. 5 is a view generally on line 5—5 of FIG. 3 of stack hold-down means of the apparatus.

Each of the six flights 7 of the endless conveyor 1 comprises a set of rods each designated 37 extending transversely with respect to the conveyor between the left and right hand chains 13 of the conveyor. The chains 13 have means for removably mounting the rods 37 at the ends of the rods whereby rods may be removed or added for changing the extent of each flight 7 and the extent of each opening or gap 9 in the conveyor lengthwise of the conveyor. Thus, each chain is a typical conveyor chain comprised of links 39 pivotally interconnected as indicated at 41 for flexing of the chain, but further having pins such as indicated at 43 in FIG. 4 extending inwardly from the inside of the chain at the pivot points, and the rods 37 are tubular flexible plastic rods (e.g. nylon rods) each mounted at its ends on two of these pins which extend inwardly from the left and right hand chains 13 in axial alignment with each other. Each rod 37 is mounted on its respective pair of pins 43 by bending it to fit between the inner ends of the pins and then allowing it to straighten out and slip onto the pins. As shown in FIG. 4, for the particular chain 13 shown, the rods are mounted on every other pair of pins 43, the pins on each chain being relatively closely spaced longitudinally of the chain. The rods 37 of each set or flight are relatively closely spaced longitudinally of the conveyor for supporting a workpiece generally flatwise thereon.

In a preferred form of the conveyor 1, the surface of the conveyor is formed by channel-shaped aluminum slats (not shown) which may be connected between the chains. The slats are preferably made of 0.031 aluminum sheets with 0.25 inch turned-down flanges. The width of each slat is approximately 0.625 inch and its length is about 24 inches. The ends of the slats are turned down and two holes are drilled in them for receiving the pins 43 to connect the slats to the conveyor chain 13. The slats, like the rods 37 can be flexed so that the pins 43 may be received in the holes in the ends of the slats to connect the slats to the chain 13. It is to be understood that the slats may have other dimension and/or be made of other materials and still fall within the scope of the present invention. The slats can be positioned together in close edge to edge relationship so that the slats form a substantially continuous upper surface for the conveyor 1.

As shown in FIG. 1, and by way of example only, each of the six flights 7 consists of eight rods 37, and extends longitudinally of the conveyor a distance corresponding to about one sixteenth the total length of the conveyor. Each of the six openings or gaps 9 extends longitudinally of the conveyor a distance corresponding to about seven sixty-fourths the total length of the conveyor. One or more rods 37 (or slats) may be removed from each flight 7, thereby decreasing its extent and increasing the extent of the openings or gaps 9, and one or more rods may be added to each flight, thereby increasing its extent and decreasing the extent of the openings or gaps.

Figure 2:
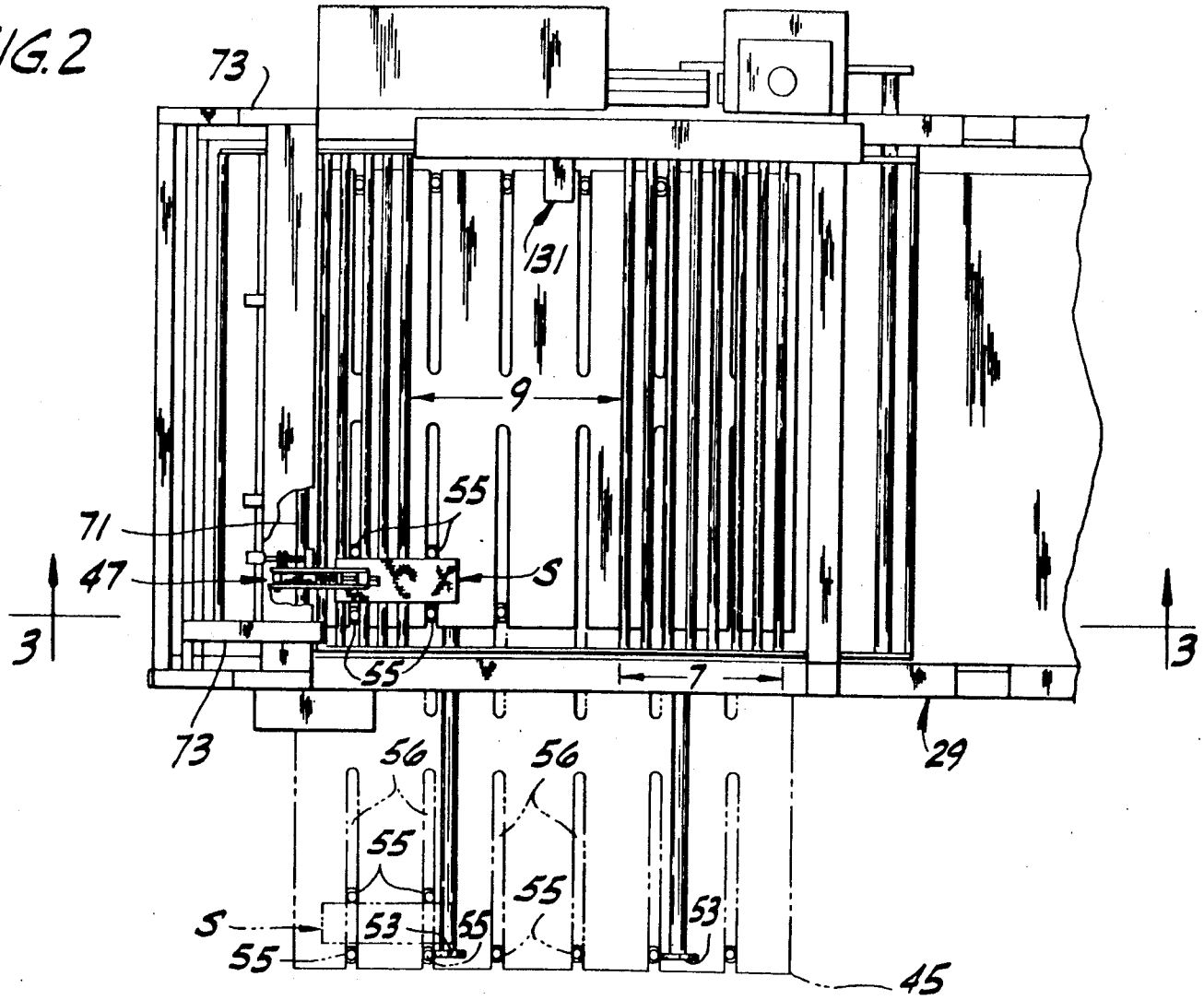
FIG. 2 is a plan of the apparatus, showing in phantom the means which holds the stack of workpieces withdrawn for loading.

At 45 is generally indicated means for holding a stack S of workpieces or plies P under the upper reach 3 of the conveyor and between the upper reach and the lower reach 5 of the conveyor, and at 47 is generally indicated transfer means operable through the openings or gaps 9 of the conveyor for picking up the top workpiece or ply of the stack, separating it from the stack, and bringing it to lie on a flight 7 of the conveyor. The stack-holding means 45 comprises a platen or table 49 mounted on a carriage generally indicated at 51 which is manually movable laterally with respect to the supporting frame 29 on guides 53 between an operation position within the frame under the upper reach 3 of the conveyor 1 and a retracted loading position as shown in phantom in FIG. 2 facilitating the placement of the stack of plies on the table. The transfer means 45 is adjustable laterally relative to the frame 29 to different positions across the top of the frame. Registration pins for registering the stack on the table are indicated at 55, these pins extending up from the carriage 51 through slots 56 in the table and being suitably adjustable on the carriage to different positions relative to the table for holding stacks in different positions on the table, for registration thereof in respect to the transfer means.

For maintaining the top ply of the stack generally at the same level for engagement of the top ply by the transfer means, the table is carried by the carriage not only for the in and out movement relative to the frame 29 between its operative position and its retracted loading position, but is also carried by the carriage for vertical movement relative to the carriage with means for moving it upwardly as plies are picked off the stack to maintain the top ply generally at the requisite constant level. For this purpose, the table is mounted on the upper ends of vertical guide rods 57 (see FIG. 3) slidable up and down in bushings 59 in the carriage and is movable up and down by the screw 61 of an electric-motor-driven screw mechanism 63 carried as indicated at 65 by the carriage, the screw extending down from the table. The arrangement is such that on operation of the motor of the ball screw mechanism to turn the nut (not shown) of the mechanism in one direction, the screw and the table are raised, and on operation of the motor to turn the nut in the other direction the screw and the table are lowered.

The transfer means 47 comprises pick-up means 49 such as shown in U.S. Pat. No. 4,157,823 issued Jun. 12, 1979, entitled Method and Means for Transporting and Orienting Limp Plys of Fabric or the Like, this pick-up means being commercially available, sold under the trademark CLUPICKER by Jet Sew of Barneveld, New York. Reference may be made to said U.S. Pat. No. 4,157,823, which is incorporated herein by reference, for full details of the pick-up means 49. Essentially, it comprises an arm 69, which may be referred to as the lift arm, pivotally mounted for swinging or rocking movement on a horizontal axis extending transversely with respect to the frame 29 and conveyor 1 above the upper reach 3 of the conveyor adjacent the trailing end of the upper reach 3 by means of a shaft 71 extending across the apparatus above the upper reach 3 adjacent its trailing end between side supports 73 at the top of the frame. The arm 69 is located in such a position that the distal end of the arm will travel from a position above the upper reach 3 of the conveyor through the gap and into engagement with the top ply P in the stack. The arm 69 extends in forward or downstream direction relative to the upper reach of the conveyor from the shaft and carries a toothed ply gripping wheel 75 (indicated at 32 in U.S. Pat. No. 4,157,823) at its free end. The lift arm 69 is swingable by means of an air cylinder 77 between a raised retracted position wherein its free end and the wheel 75 are above the level of the upper reach 3 of the conveyor 1 (see FIG. 1) and the lowered operating position in which it appears in FIG. 3 wherein the wheel 75 engages the uppermost ply of the stack of plies. The air cylinder 77 is pivoted at one end as indicated at 79 on a support 81 at the top of the frame 27 and has its piston rod 83 pin-connected as indicated at 85 to an arm 87 extending up from the lift arm 69. The wheel 75 has a pinion such as indicted at 562 here and in U.S. Pat. No. 4,157,823 which is operable by a rack 89 extending from the piston rod 91 of an air cylinder 93 pin-connected at one end as indicated at 95 to an arm 97 extending rearward from the lift arm 69. A presser unit 99 (designated 102 in U.S. Pat. No. 4,157,823) is pivoted on the axis of the wheel and has an "accumulation slot" 101 (designated 118 in U.S. Pat. No. 4,157,823). The lift arm is held by the cylinder 77 in its raised retracted position wholly above the upper reach of the conveyor when a flight 7 of the upper reach is travelling under the arm (see FIG. 1). It is swung down by cylinder 77 to its lowered position (see FIG. 3) for engagement of the presser unit 99 and the wheel 75 with the top ply P of the stack S when a gap 9 in the conveyor comes over the stack enabling downward swing of the lift arm through the gap. When the presser unit and wheel have moved down into engagement with the stack, the wheel is rotatable in counterclockwise direction as viewed in FIG. 3 by operation of the cylinder 93 and the rack 89 to form a fold in the top ply and feed the fold into the accumulation slot 101 for grasping of the top ply adjacent its rearward or trailing end, the stack being positioned for grasping of the top ply adjacent its said end, all as described in detail in U.S. Pat. No. 4,517,823. When the presser unit and wheel move up with the lift arm to the raised retracted position, the wheel is rotated in clockwise direction by operation of cylinder 93 to return the rack to pull the fold out of the slot 101 to effect release of the ply.

The transfer means 47 may also be a Walton picker (not shown) manufactured by Robotic Systems & Components Co. of Whitinsville, Mass., and available through PickRobotics of Whitinsville, Mass. For a disclosure of the details of the structure and operation of the Walton picker, reference is made to U.S. Pat. No. 4,645,193, which is incorporated herein by reference. The Walton picker may be similarly mounted for pivoting motion through the openings 9 to engage and grasp a top ply in the stack to separate the top ply from the stack.

Figure 3:
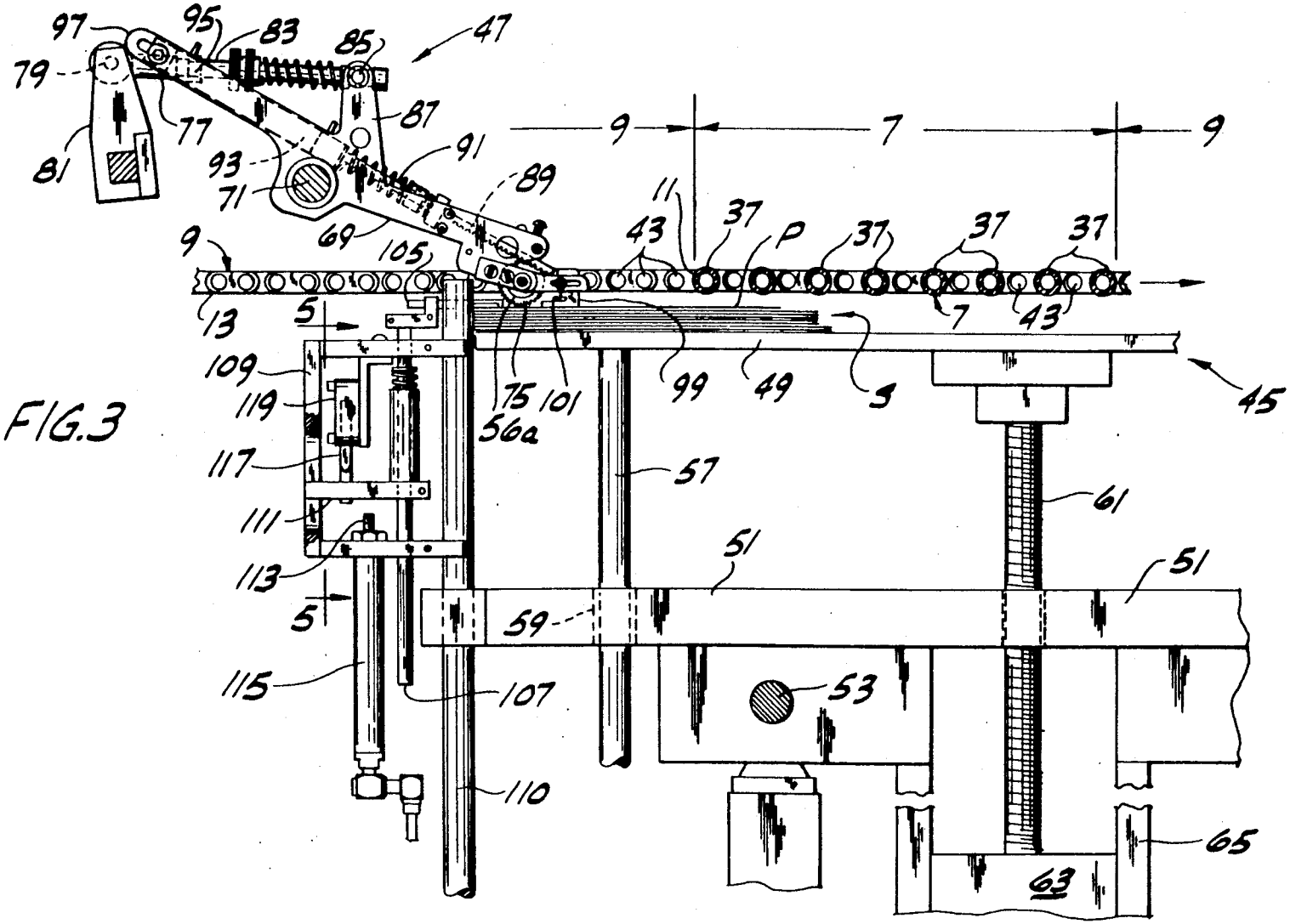
FIG. 3 is a view in vertical section generally on line 3—3 of FIG. 2 showing the stack-holding means with the stack of workpieces ("plies") thereon and the workpiece pick-up means in lowered position for grasping the top workpiece (the top ply) adjacent its trailing end preparatory to lifting it.
Figure 6:
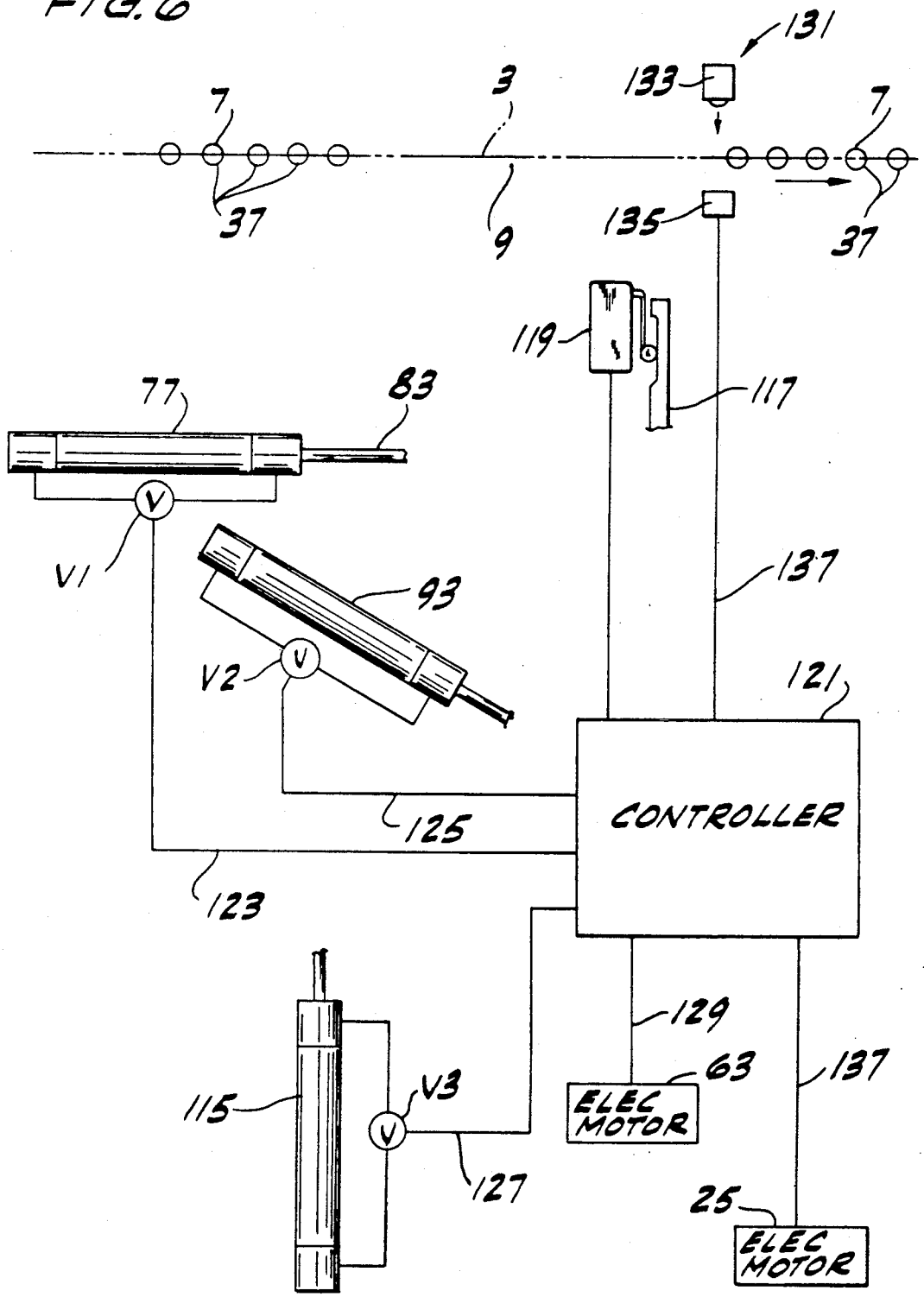
FIG. 6 is a diagrammatic view illustrating circuitry of the apparatus.

Means indicated generally at 103 in FIG. 3 is provided for holding the stack S down on the table. This means is shown to comprise a hold-down finger 105 on a rod 107 which is vertically slidable in a C-shaped bracket 109 carried by a post 110 at the rearward or trailing end of the table 49. The rod 107 and finger 105 carried thereby are biased downwardly by gravity and movable upwardly to raise the finger off the top of the stack by having an arm 111 projecting laterally from the rod engageable by the piston rod 113 of an air cylinder 115 carried by the bracket extending down from the bracket. The arm 111 has a pin 117 extending upwardly therefrom formed as shown in FIG. 6 for actuating a switch 119 when the tip of the finger 105 goes below the requisite elevation for the top of the stack. Post 110 is suitably adjustable laterally with respect to the frame 29 for positioning the hold-down means according to the position of the stack.

The apparatus is under control of a programmable controller such as indicated at 121 in FIG. 6, which may be a Shark X-903 controller sold by Reliance Electric Corp. through their dealers in major cities. This controls valves V1, V2, and V3 for air cylinders 77, 93 and 115 and the motor of the ball screw mechanism 63 as indicated at 123, 125, 127 and 129. At 131 is indicated means for sensing the passage of each opening or gap 9 in the conveyor 1 over the stack S of plies P on the table 49, this means being an electric eye means having a light source 133 which projects a beam of light toward the upper reach of the conveyor, the beam impinging on an electric eye 135 when a conveyor gap 9 passes between the light source and eye. The eye means is of the type having a built-n delay so that it is not activated when the beam shines through the narrow spaces between adjacent rods 37 of a conveyor flight 7. The eye means is activated when the trailing edge 11 of each flight clears the beam of light and transmits a signal to the controller 121 over a line as indicated at 137 to initiate a cycle of operation of the pick-up means 47. This cycle begins when the trailing edge 11 of a flight clears the arcuate path of the presser unit 99 and wheel 75. Under control of the controller 121, and on a time basis, the valve V1 for cylinder 77 is activated to actuate the cylinder to swing the lift arm 69 down through the underlying gap 9 for engagement of the presser unit 99 and wheel 75 with the top ply P of the stack S adjacent the rearward (trailing) end of the top ply. The valve V3 for the cylinder 115 is then activated to actuate cylinder 115 to raise the hold-down finger 105 from the top of the stack and the valve V2 for cylinder 93 is activated to actuate this cylinder to drive the rack 89 forward and rotate wheel 75 counterclockwise to fold the top ply and push the fold into the accumulations lot 101, thereby to effect the grasping of the top ply adjacent its rearward end by the pick-up arm 69. Once the fold has been pushed into the accumulation slot, valve V3 is deactivated to deactuate cylinder 115 and allow the hold-down finger 105 to drop into hold-down engagement with the stack. The valve V1 for cylinder 77 is then deactivated to activate cylinder 77 to swing up the lift arm 69, grasping the top ply adjacent the trailing end of the top ply, thereby effecting separation of the top ply from the stack S and lifting of the ply to the position such as shown in FIG. 1 wherein it extends down in the underlying opening or gap 9 of the upper reach 3 of the conveyor 1 for engagement of the bottom surface of the ply by the leading edge 10 of the oncoming flight 7 of the upper reach of the conveyor. The leading edge 10 of the oncoming flight wipes under the raised ply, completing the separation of the ply from the stack, and the separated ply is brought to lie flat on the oncoming flight. The valve V2 is deactivated to activate cylinder 93 for return of the rack 89 to rotate wheel 75 clockwise to pull the fold in the ply out of the slot 102 for release of the ply from the pick-up means to complete the laying thereof on the oncoming flight, and the latter then carries the ply forward and delivers it to the operating means (e.g. sewing apparatus). As the plies are picked off, the switch 119 is activated when the top of the ply goes below the requisite elevation for engagement of the presser unit 99 and wheel 75 with the top ply, and actuates the motor of the ball screw mechanism 63 to raise the table 49 to bring the top of the stack back up to that elevation.

Figure 7:
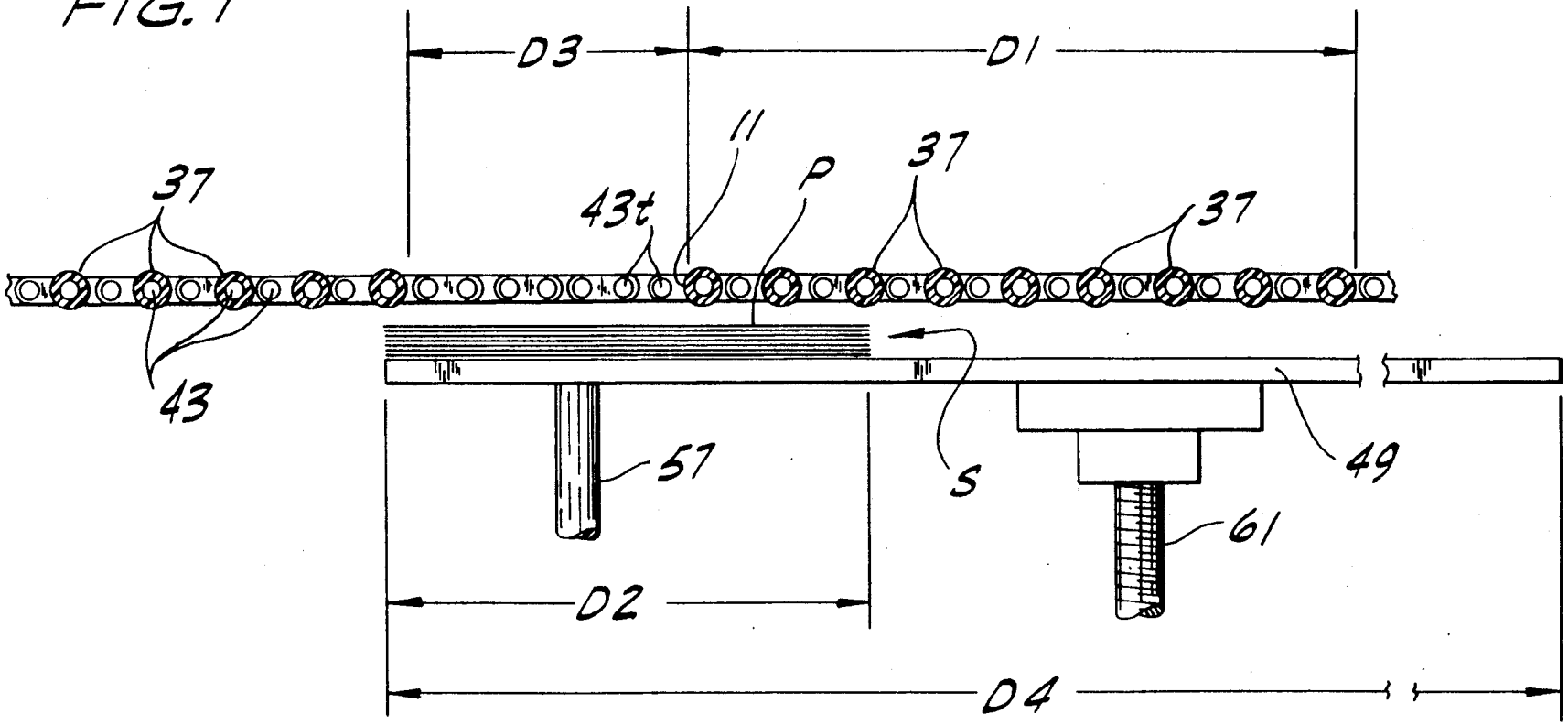
FIG. 7 is an enlarged, fragmentary view in vertical section illustrating the relative sizes of the plies and the conveyor flights.

Referring now to FIG. 7, each conveyor flight 7 is constructed so that its dimension D1 parallel to the direction of travel of the conveyor 1 is at least as great as the greatest dimension D2 of the plies P in the direction of travel of the conveyor. In order for the plies P to be properly processed (e.g., by a sewing machine) at the workstation to which they are delivered, they must come into the workstation in a flat, unfolded configuration. Should the conveyor flight 7 be shorter than the ply P in the direction of travel of the conveyor 1, an edge margin of the ply (not shown) will hang over the leading or trailing edge (10 or 11) of the conveyor. The edge margin of the ply P hanging over the edge of the conveyor flight 7 is likely to fold underneath the ply at the workstation so that the Ply is not presented in a flat, unfolded configuration to the workstation.

It will be observed that, once the stack S of plies P has been placed on the table 49 and the table pushed in to its operative position under the upper reach of the conveyor 1, on operation of the conveyor (usually continuously) plies are automatically and efficiently picked off the stack, laid on the conveyor flights 7 in the upper reach 3 of the conveyor, and delivered to the operating means (e.g. sewing apparatus) at the leading end of the upper reach. The apparatus is capable of operating at relatively high speeds without shifting of the plies on the conveyor flights as they are fed forward. The speed of the conveyor may be varied by varying the speed of the motor, and the timing of the pick-up may be correlated with the conveyor speed (note the interconnection indicated in FIG. 6 at 137 between motor 25 and the controller 121. The length of the flights 7 and the length of the gaps 9 (in the direction of length of the conveyor) may be readily varied as described for efficiently handling plies of different length, up to a relatively extensive length, and the width of the flights and gaps may be made such as to accommodate plies up to a relatively extensive width. For example, it is contemplated that the apparatus may handle plies from 2"×2" plies up to 24"×24" plies.

As shown in FIG. 7, the space D3 between trailing edges 11 and leading edges 10 of adjacent flights 7 of the conveyor 1 is preferably small so that the rate at which the plies P can be delivered is maximized at a given conveyor speed. Because the plies P are limp and hang substantially straight down from the pick up arm 69 when lifted up adjacent one edge, the only limitation on the spacing between adjacent flights 7 is the speed with which the pick up arm 69 can pivot through the opening 9 between adjacent flights, grasp the top ply and move back through the opening before the leading edge 10 of the trailing conveyor flight moves into the travel path of the pick up arm. The transfer means 47 is operable to quickly move through the opening 9 between adjacent flights 7 to grasp and lift up an edge of the ply so that only a relatively small space D3 is required between adjacent flights. Thus, for plies of average to large length D2 (e.g., 10"-24") in the direction of travel of the upper reach 3 of the conveyor, the space D3 between flights 7 is substantially less than the length of the ply. For example, to feed 20 plies a minute to a workstation at a conveyor speed of 54 feet per minute, the space D3 between adjacent flights is set at 8"-9". Thus, for plies having a dimension D2 in the direction of travel of the conveyor of 24", the separation D3 between adjacent flights is approximately 33% of the ply dimension.

The close spacing of the flights 7 can be expressed in terms of the ratio of the distance D3 between adjacent flights to the dimension D4 of the table 49 holding the stack of plies. The dimension D4 of the table will be at least as large as the dimension D2 of the largest ply to be handled by the apparatus, although typically it will be somewhat larger so that the largest ply may easily lie flat on the table 49. However, the length D4 of the table generally corresponds to the dimension D2 of the longest ply. It has been found that the distance D3 between adjacent flights 7 can be less than 25% of the table dimension, up to a minimum spacing of about 2" between flights. This limit is primarily dictated by the size of the pick-up arm 69. Thus, for all but the smallest plies, the spacing D3 between adjacent flights 7 will be less that the dimension D2 of the ply.

It is to be understood that the delivery rate of 20 pieces per minute is defined by the processing speed of the workstation, and does not represent the maximum capacity of the apparatus. In addition, the delivery rate of plies P is dependent upon the length of the plies being delivered. Small plies require correspondingly shorter flights on which to be supported. Therefore, a greater number of flights can be used on the conveyor and, consequently, the small plies can be delivered more rapidly at a given conveyor speed than a larger ply at the same conveyor speed. However, as a example of the capacity of the apparatus, it is believed that the apparatus can deliver plies which have a dimension D2 of 11" in the direction of travel of the upper reach 3 of the conveyor at a rate of 40½ plies per minute at a conveyor speed of 54 feet per minute, with a spacing between adjacent flights of 5"-6".

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for automatically feeding workpieces of limp material one at a time and one after another from a stack thereof to means for operating thereon, said apparatus comprising:

an endless conveyor having a forward-traveling upper reach for conveying said workpieces to said operating means and a lower return reach;

said conveyor having a series of flights spaced at intervals therealong with openings between the flights;

each flight being constructed for carrying a workpiece thereon with the workpiece lying on the flight and having a leading edge at that opening which leads the flight;

means for driving the conveyor for forward travel of its upper reach;

means under the upper reach of the conveyor and between the upper and lower reaches of the conveyor for holding a stack of said workpieces, said means for holding a stack having a dimension parallel to the direction of travel of the upper reach of the conveyor which is at least as long as the dimension of the largest workpiece to be handled by the apparatus in the direction of travel of the upper reach of the conveyor, the spacing between adjacent flights of the conveyor being less than 50% of said dimension of said means for holding a stack; and transfer means for picking up the top workpiece of the stack, separating it from the stack, and bringing it to lie on a flight;

said transfer means comprising pick-up means movable from a retracted position above the upper reach of the conveyor down through an opening in the conveyor into engagement with the top workpiece of the stack as the upper reach of the conveyor moves continuously forwardly, said pick-up means being operable to grasp said top workpiece and then being movable back upwardly through said opening to effect separation of said workpiece from the stack and lifting of said workpiece to a position wherein it extends down in the opening from said pick-up means for engagement of its bottom surface by the leading edge of the oncoming flight to complete the separation of said workpiece from the stack and to bring it to lie generally flat on said oncoming flight, said pick-up means then releasing said workpiece to complete the laying thereof on said oncoming flight.

2. Apparatus as set forth in claim 1 wherein said pick-up means includes an arm pivoted for swinging movement on an axis extending transversely with respect to the conveyor above the upper reach of the conveyor, the arm being located with respect to the upper reach of the conveyor such that the pivoting motion of the arm carries at least a portion of the arm from a position above the upper reach of the conveyor, through an opening in the conveyor into engagement with the top workpiece of the stack of workpieces.

3. Apparatus as set forth in claim 1 having means for effecting engagement of said pick-up means with each successive top workpiece of the stack as the workpieces are picked up and separated from the stack.

4. Apparatus as set forth in claim 3 wherein the means for holding the stack comprises a vertically movable table and wherein means is provided for raising the table as workpieces are picked off to maintain the top workpiece generally at a relatively constant elevation for engagement thereof by the pick-up means.

5. Apparatus as set forth in claim 1 having means for sensing the passage of an opening in the conveyor over the stack and activating the pick-up means on the passage of each opening over the stack.

6. Apparatus as set forth in claim 1 wherein the spacing between adjacent flights of the conveyor is less than 25% of said dimension of said means for holding a stack parallel to the direction of travel of the upper reach of the conveyor.

* * * * *